US005728659A

United States Patent [19]

Naka et al.

[11] Patent Number: 5,728,659

[45] Date of Patent: Mar. 17, 1998

[54] GREASE COMPOSITIONS FOR ROLLING BEARING

[75] Inventors: Michiharu Naka, Odawara; Atsushi Yokouchi, Yokohama; Hideki Koizumi, Chigasaki; Kenichi Iso, Yamato; Hirotugu Kinoshita, Yokohama; Souichi Nomura, Tokyo; Fumihiro Itano, Yokohama, all of Japan

[73] Assignees: NSK Ltd.; Nippon Oil Co., Ltd., both of Tokyo, Japan

[21] Appl. No.: 793,852

[22] PCT Filed: Jun. 20, 1996

[86] PCT No.: PCT/JP96/01709

§ 371 Date: Feb. 20, 1997

§ 102(e) Date: Feb. 20, 1997

[87] PCT Pub. No.: WO97/00927

PCT Pub. Date: Jan. 9, 1997

[30] Foreign Application Priority Data

Jun. 22, 1995 [JP] Japan ..... 7-156293

[51] Int. Cl.[6] ..... C10M 115/08

[52] U.S. Cl. ..... 508/552; 508/581

[58] Field of Search ..... 508/552, 581; C10M 115/08, 133/20

[56] References Cited

U.S. PATENT DOCUMENTS

| | | | |
|---|---|---|---|
| 2,710,839 | 6/1955 | Swakon et al. | 508/552 |
| 4,115,284 | 9/1978 | Kinoshita et al. | 508/552 |
| 4,668,411 | 5/1987 | Yasui et al. | 508/552 |
| 5,370,808 | 12/1994 | Onishi et al. | 508/552 |
| 5,462,684 | 10/1995 | Naka | 508/552 |
| 5,498,357 | 3/1996 | Naka et al. | 508/552 |
| 5,589,444 | 12/1996 | Hatakeyama | 508/552 |
| 5,604,187 | 2/1997 | Takeuchi et al. | 508/552 |

FOREIGN PATENT DOCUMENTS

| | | |
|---|---|---|
| 3-79698 | 4/1981 | Japan . |
| 61-155496 | 7/1986 | Japan . |
| 1-259097 | 10/1989 | Japan . |

*Primary Examiner*—Prince Willis, Jr.
*Assistant Examiner*—Cephia D. Toomer
*Attorney, Agent, or Firm*—Darby & Darby

[57] ABSTRACT

A grease composition for a rolling bearing comprising, based on 100 parts by weight of a base oil, 10 to 60 parts by weight of a mixture of diurea compounds as a thickener having a composition of 25 to 90 mol % of a diurea compound represented by the formula (1), 9 to 50 mol % of a diurea compound represented by the formula (2), 1 to 30 mol % of a diurea compound represented by the formula (3), wherein $R^1$ stands for an aromatics-containing hydrocarbon group having 7 to 12 carbon atoms, $R^2$ stands for a divalent aromatics-containing hydrocarbon group having 6 to 15 carbon atoms, and $R^3$ stands for a cyclohexyl group or an alkylcyclohexyl group having 7 to 12 carbon atoms, a value of (number of $R^1$/(number of $R^1$+number of $R^3$)) in the mixture being 0.55 to 0.95.

$$R^1-NHC(=O)NH-R^2-NHC(=O)NH-R^1 \quad (1)$$

$$R^1-NHC(=O)NH-R^2-NHC(=O)NH-R^3 \quad (2)$$

$$R^3-NHC(=O)NH-R^2-NHC(=O)NH-R^3 \quad (3)$$

9 Claims, No Drawings

GREASE COMPOSITIONS FOR ROLLING BEARING

FIELD OF ART

The present invention relates to a grease composition for rolling bearings. More particularly, it relates to a grease composition employed for rolling bearings in electrical components and accessory devices for automotive vehicles, such as alternators, electromagnetic clutches for car air conditioners, idle pulleys, electric fan motors, or the like.

BACKGROUND OF THE INVENTION

In automotive vehicles, for keeping up with the propagation FF (front engine-front wheel driven) cars aiming at reducing size and weight of the vehicles, and with the demand for an increased cabin space within the cars, the engine room space has necessarily been reduced, so that the size and weight of the electrical components and accessories such as alternators, electromagnetic clutches for car air conditioners, idle pulleys, or electric fan motors have further been reduced. On the other hand, higher performance and higher output power are demanded of the electrical components and accessories. Therefore, for example, reduction in output power caused by size reduction of an alternator is compensated by increasing the designed speed. Further, to keep up with the demand for quiet operation, the degree of hermetic sealing of the engine room is advanced and hence the engine room tends to be heated, so that components capable of withstanding higher temperatures are required. In these electrical components and accessories, rolling bearings are used, and lubrication of the rolling bearings is achieved mainly by using a grease. Currently, the greases for use in sealed bearings employed in electrical components and accessories for automotive vehicles are required to achieve longer flaking life and bearing lubricating life, less grease leakage, superior low-temperature properties, superior rust-preventive properties, and superior noiseless operation of the bearings.

Japanese Laid-open Patent Application Nos. 5-98280, 5-194979, and 5-263091 disclose greases containing as a thickener a diurea compound having aromatics containing-hydrocarbon groups at most of its terminals. These greases have prolonged flaking life on the bearings, but have inferior fluidity, so that they cause burning of the bearings under high temperature and high speed operative conditions, leaving problems in bearing lubrication life.

Japanese Laid-open Patent Application Nos. 3-79698, 5-140576, and 6-17079 disclose greases containing as a thickener a diurea compound having cyclohexyl groups at most of its terminals. These greases have prolonged bearing lubrication life under high temperature and high speed operative conditions, but do not have sufficient flaking life.

Japanese Laid-open Patent Application No. 4-253796 discloses a grease containing as a thickener a diurea compound having both a cyclohexyl group and an alkyl group at its terminals. Japanese Laid-open Patent Application No. 6-88085 discloses a grease containing as a thickener a diurea compound having an aromatics-containing hydrocarbon group, a cyclohexyl group, and an alkyl group at its terminals. These greases have inferior flaking life and shear stability, and cause high degree of grease leakage.

Japanese Laid-open Patent Application No. 61-155496 discloses a grease containing as a thickener a diurea compound having a long chained alkylphenyl group and a cyclohexyl group at its terminals. This grease exhibits enough durability under a certain degree of high temperature and high speed operative conditions, but does not exhibit enough durability under severe conditions such as dmn value of not less than 600,000 and the temperature of not lower than 150° C.

DISCLOSURE OF THE INVENTION

It is an object of the present invention to provide a grease composition for a rolling bearing having a greatly prolonged bearing lubricating life and flaking life particularly under high temperature and high speed operative conditions of the bearings.

According to the present invention, there is provided a grease composition for a rolling bearing comprising 10 to 60 parts by weight of a mixture of diurea compounds as a thickener based on 100 parts by weight of a base oil, said mixture of diurea compounds having a composition of:

(a) 25 to 90 mol % of a diurea compound represented by the formula (1)

$$R^1-NHC(=O)NH-R^2-NHC(=O)NH-R^1, \quad (1)$$

(b) 9 to 50 mol % a diurea compound represented by the formula (2)

$$R^1-NHC(=O)NH-R^2-NHC(=O)NH-R^3, \text{ and} \quad (2)$$

(c) 1 to 30 mol % of a diurea compound represented by the formula (3)

$$R^3-NHC(=O)NH-R^2-NHC(=O)NH-R^3, \quad (3)$$

wherein $R^1$ stands for an aromatics-containing hydrocarbon group having 7 to 12 carbon atoms, $R^2$ stands for a divalent aromatics-containing hydrocarbon group having 6 to 15 carbon atoms, and $R^3$ stands for a cyclohexyl group or an alkylcyclohexyl group having 7 to 12 carbon atoms, a value of (number of $R^1$/(number of $R^1$+number of $R^3$)) in said mixture being 0.55 to 0.95.

BEST MODE FOR CARRYING OUT THE INVENTION

The present invention is now explained in detail.

The grease composition for a rolling bearing of the present invention utilizes as a thickener a mixture of diurea compounds having a composition of 25 to 90 mol %, preferably 50 to 70 mol %, more preferably 60 to 65 mol % of a diurea compound represented by the above formula (1); 9 to 50 mol %, preferably 15 to 40 mol %, more preferably 15 to 35 mol % of a diurea compound represented by the above formula (2); and 1 to 30 mol %, preferably 1 to 15 mol %, more preferably 5 to 15 mol % of a diurea compound represented by the formula (3).

In each of the formulae (1), (2), and (3), $R^1$ stands for an aromatics-containing hydrocarbon group having 7 to 12 carbon atoms such as a toluyl group, a xylyl group, a β-phenethyl group, a t-butylphenyl group, a dodecylphenyl group, a benzyl group, or a methylbenzyl group. $R^2$ stands for a divalent aromatics-containing hydrocarbon group having 6 to 15 carbon atoms, and following examples of groups are particularly preferred as $R^2$:

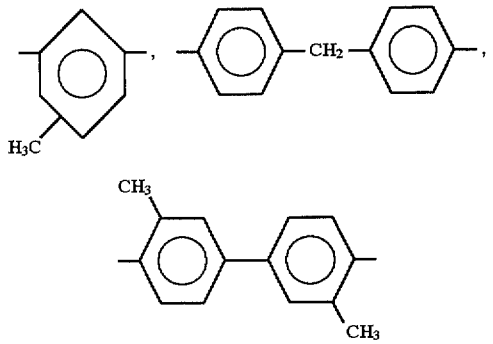

$R^3$ stands for a cyclohexyl group or an alkylcyclohexyl group having 7 to 12 carbon atoms such as a cyclohexyl group, a methylcyclohexyl group, a dimethylcyclohexyl group, an ethylcyclohexyl group, a diethylcyclohexyl group, a propylcyclohexyl group, an isopropylcyclohexyl group, a 1-methyl-3-propylcyclohexyl group, a butylcyclohexyl group, a pentylcyclohexyl group, a pentylmethylcyclohexyl group, or a hexylcyclohexyl group. Among these, a cyclohexyl group or an atkylcyclohexyl group having 7 to 8 carbon atoms, for example, a methylcyclohexyl group or an ethylcyclohexyl group, is particularly preferred.

As the diurea compound represented by the formula (1), (2), or (3), following examples of compounds may preferably be used in particular.

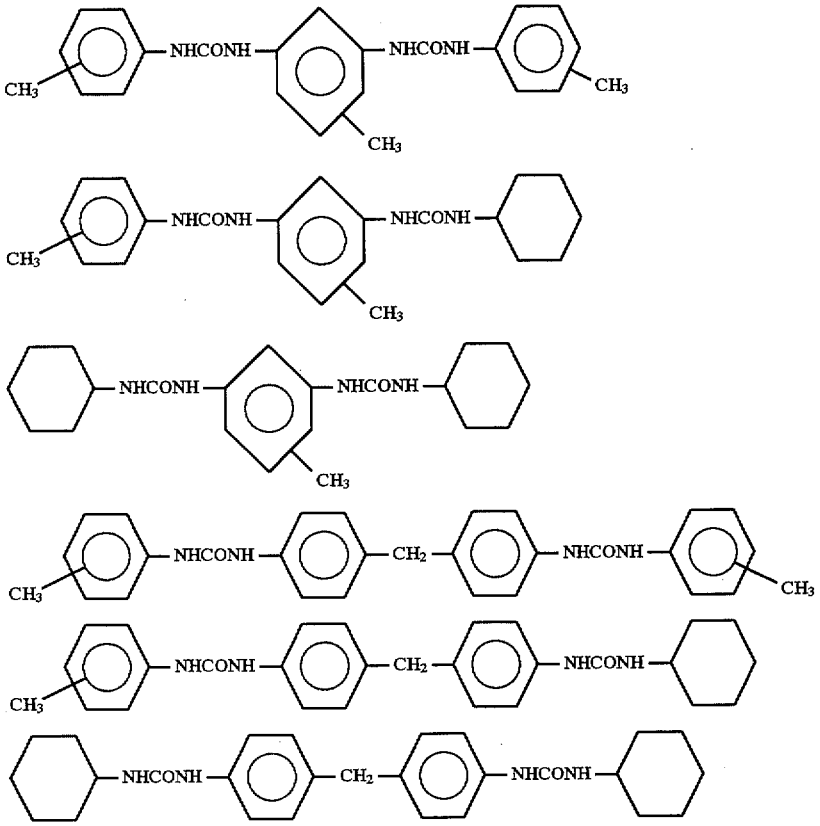

In the mixture of diurea compounds, the ratio of the number of $R^1$ to the total number of $R^1$ and $R^3$, i.e. the value of (number of $R^1$/(number of $R^1$+number of $R^3$)) is 0.55 to 0.95, preferably 0.6 to 0.9, more preferably 0.65 to 0.85. If this value is less than 0.55, sufficient flaking life is not obtained, whereas if it is more than 0.95, fluidity is lowered, causing possible burning of the bearings.

In the grease composition of the present invention, the content of the thickener is 10 to 60 parts by weight, preferably 15 to 55 parts by weight, more preferably 20 to 50 parts by weight based on 100 parts by weight of the base oil. If the content of the thickener is less than 10 parts by weight, gelling property of the grease is not enough, and sufficient solidity cannot be achieved, thereby increasing the risk of grease leakage. On the other hand, if the content of the thickener is more than 60 parts by weight, durability under high temperature and high speed operative conditions is remarkably lowered.

The mixture of the diurea compounds as a thickener may be obtained by preparing each of the compounds represented by the formulae (1) to (3), respectively, by publicly known methods, and mixing the obtained compounds at the desired mixing ratio. The mixture of the diurea compounds may otherwise be produced in one step by reacting a diisocyanate represented by the formula OCN-$R^2$-NCO, a primary amine represented by the formula $R^1$-$NH_2$, and a primary amine represented by the formula $R^3$-$NH_2$ (wherein $R^1$ to $R^3$ are the same as the $R^1$ to $R^3$ in the above formulae (1) to (3)) preferably at 10° to 200° C., more preferably at 60° to 100° C. In order to react the materials subjected to reaction without excess and deficiency, preferred molar ratio for the reaction of the diisocyanate to the above primary amines in combination is substantially 1:2. Preferred molar ratio for the reaction of the primary amine represented by the formula $R^1$-$NH_2$ to the primary amine represented by the formula $R^3$-$NH_2$ is usually 6:4 to 9:1, more preferably 8:2 to 7:3. If the molar ratio for the reaction of each component is outside the above range, a thickener having the desired molar ratio of the components is hardly obtained, thus being not preferred. In the reaction, a volatile solvent may be used, but the base oil may also act as a solvent to obtain the grease composition of the present invention without other solvent.

The base oil used in the grease composition of the present invention is not particularly limited, and any oil used as a base oil for a lubricating oil may usually be used. In order to prevent increase in the starting torque of the bearings due to insufficient fluidity of the grease at a lower temperature, and high risk of burning of the bearings due to difficulties of the grease in forming an oil layer at a higher temperature, the base oil having kinematic viscosity of preferably 40 to 400 $mm^2/s$, more preferably 60 to 250 $mm^2/s$, most preferably 80 to 150 $mm^2/s$ at 40° C. is preferred. The kinematic viscosity is usually determined based on a value measured with a glass capillary viscometer.

The base oil may be a mineral, a synthetic, or a natural lubricant base oil. The mineral lubricant base oil may be prepared by purifying a mineral oil by a process wherein distillation under reduced pressure, solvent deasphalting, solvent extraction, hydrocracking, solvent dewaxing, washing with sulfuric acid, clay purification, hydrofining, or the like are suitably combined. The synthetic lubricant base oil may be a hydrocarbon oil, an aromatic oil, an ester oil, or an ether oil.

Examples of the hydrocarbon oil may include poly-α-olefins such as normal paraffin, isoparaffin, polybutene, polyisobutylene, a 1-decene oligomer, a cooligomer of 1-decene and ethylene, or hydrides thereof.

Examples of the aromatic oil may include alkylbenzenes such as monoalkylbenzene, dialkylbenzene, or polyalkylbenzene; or alkylnaphthalenes such as monoalkylnaphthalene, dialkylnaphthalene, or polyalkylnaphthalene.

Examples of the ester oil may include diesters such as di-2-ethylhexyl sebacate, dioctyl adipate, diisodecyl adipate, ditridecyl adipate, or ditridecyl glutarate; or polyol esters such as trimethylol propane caprylate, trimethylol propane pelargonate, pentaerythritol-2-ethyl hexanoate, or pentaerythritol pelargonate.

Examples of the ether oil may include polyglycols such as polyethylene glycol, polypropylene glycol, polyethylene glycol monoether, or polypropylene glycol monoether; phenyl ethers such as monoalkyl triphenyl ether, alkyl diphenyl ether, dialkyl diphenyl ether, pentaphenyl ether, tetraphenyl ether, monoalkyl tetraphenyl ether, or dialkyl tetraphenyl ether.

Examples of other synthetic lubricant base oil may include tricresylphosphate, silicon oil, or perfluoroalkyl ether. These base oils may be used alone or as a mixture.

In the present invention, any base oil may suitably be used. However, in order to further prolong the grease life and the flaking life of the grease for rolling bearings, usually the base oil preferably contains 10 to 100% by weight of a base oil having a kinematic viscosity preferably within the above range and containing as requisite components dialkyl diphenyl ether and/or ester synthetic oil, based on the total weight of the base oil. When the base oil containing dialkyl diphenyl ether is used, the preferred content of dialkyl diphenyl ether is 50 to 100% by weight of the total weight of the base oil, whereas when the base oil containing ester synthetic oil is used, the preferred content of the ester synthetic oil is 20 to 100% by weight of the total weight of the base oil. When a base oil other than dialkyl diphenyl ether and/or ester synthetic oil is used in addition, this base oil is preferably poly-α-olefin, and the preferred content thereof is not more than 80% by weight of the total weight of the base oil. When dialkyl diphenyl ether is used together with poly-α-olefin, the preferred content of poly-α-olefin is not more than 50% by weight of the total weight of the base oil. When ester synthetic oil is used together with poly-α-olefin, the preferred content of poly-α-olefin is not more than 80% by weight of the total weight of the base oil.

The dialkyl diphenyl ether may be represented by the following formula (4). In the formula, $R^4$, $R^5$, and $R^6$ are the same or different groups, one of which stands for a hydrogen atom, each of the other two of which stands for an alkyl group, preferably a straight chain alkyl group having 8 to 20 carbon atoms, more preferably 12 to 14 carbon atoms.

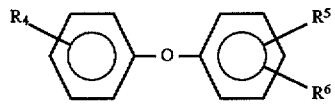

(4)

Specific examples of the dialkyl diphenyl ether may include the compounds represented by the following formulae, respectively, which compounds may be used alone or as a mixture:

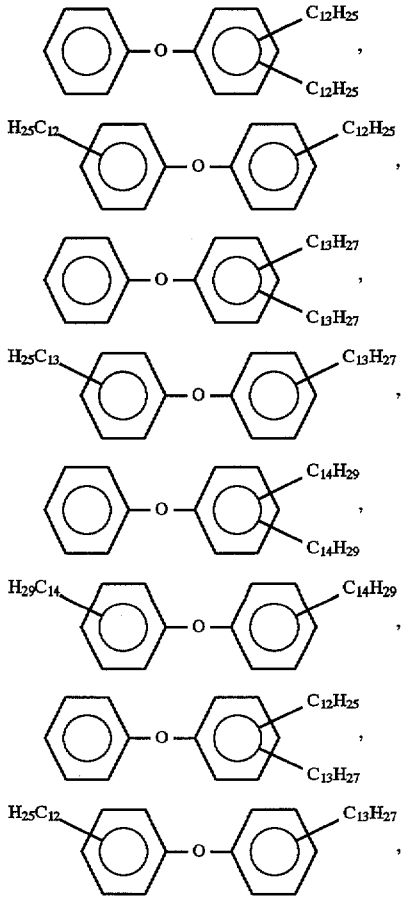

-continued

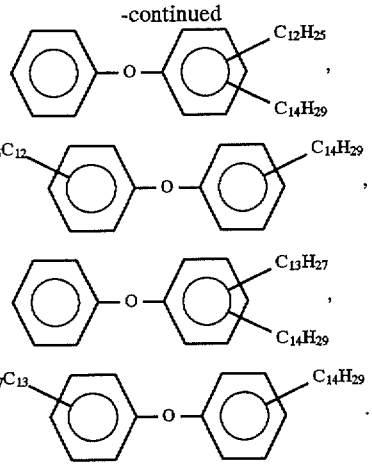

The poly-α-olefin may be represented by the following formula (5). In the formula, $R^7$ stands for an alkyl group. Two or more different alkyl groups may be present in a molecule, but $R^7$ preferably stands for a n-octyl group. n is preferably an integer of 3 to 8.

$$H\text{-}(CH_2-\underset{\underset{R^7}{|}}{CH})_n\text{-}H \quad (5)$$

The poly-α-olefin employed may be one kind, or a mixture of different poly-α-olefins having different $R^7$ and/or n in the formula.

Further, the grease composition of the present invention may optionally contain publicly known additives in order to further improve its excellent properties. Examples of the additives may include a gelling agent such as a metal soap, bentone, or silica gel; an antioxidant such as amine, phenol, or sulfur antioxidant, or zinc dithiophosphate; an extreme pressure agent such as chlorine, sulfur, or phosphor extreme pressure agent, or zinc dithiophosphate, or organomolybdenum; an oilness agent such as fatty acids or animal or vegetable oils; a rust preventives such as petroleum sulfonate, dinonyl naphthalene sulfonate, or sorbitan ester; a metal deactivator such as benzotriazole or sodium nitrite; or a viscosity index improvers such as polymethacrylate, polyisobutylene or polystyrene. These additives may be used alone or as a combination of two or more kinds. The amount of the additives to be added is not particularly limited as long as the desired object of the present invention is to be achieved, but usually not more than 20% by weight of the grease composition.

The grease composition of the present invention may be prepared by uniformly mixing with the base oil, the mixture of the diurea compounds as a thickener, and optionally other thickener and additives. The grease composition of the present invention may otherwise be obtained by preparing the mixture of the diurea compounds as a thickener in one step of reaction using the base oil as a solvent to directly produce the grease composition of the present invention, and optionally adding a variety of admixtures thereto subsequently.

Since the grease composition of the present invention contains as a thickener the mixture of the diurea compounds having the specific compositions, it has a greatly prolonged bearing lubricating life and flaking life on the bearings particularly under high temperature and high speed operative conditions. Therefore, it is particularly useful as a grease composition for rolling bearings used for electrical components and accessories of automotive vehicles.

EXAMPLES

The present invention is now explained more specifically with reference to Examples and Comparative Examples, but the present invention is not limited thereto.

EXAMPLE 1

0.78 mol of tolylene diisocyanate (abbreviated as TDI hereinafter) was added to 100 parts by weight of polyol ester as a base oil, and dissolved under heating at 60° C. To the obtained mixture was further added 1.40 mol of p-toluidine and 0.16 mol of cyclohexyl amine, and dissolved and reacted under heating at 70° C. Then the obtained mixture was stirred to give a gel, which was then passed through a roll mill, thereby obtaining the object grease. The composition of the obtained grease was measured to find that 50 parts by weight of a mixture of diurea compounds was contained as the thickener based on 100 parts by weight of the base oil, which mixture had a composition of 81 mol % of diurea compound represented by the formula To-NHCONH-T-NHCONH-To, 18 mol % of diurea compound represented by the formula To-NHCONH-T-NHCONH-Cy, and 1 mol % of diurea compound represented by the formula Cy-NHCONH-T-NHCONH-Cy, wherein To stands for a tolyl group, Cy stands for a cyclohexyl group, and T stands for a group represented by the formula:

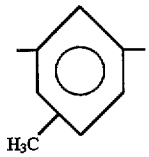

and in which mixture a value of (number of To/(number of To+number of Cy)) was 0.90.

The obtained grease was measured of kinematic viscosity at 40° C. with a glass capillary viscometer, and of mixture consistency with a ½ penetrometer. Subsequently, the following tests were conducted. Results of each measurement and results of each test are shown in Table 1, and the composition of the thickener in the grease composition are shown in Table 2.

Quick Accelerating-Decelerating Test 2.3 g of a grease was sealed in deep groove ball bearings (with a plastic cage) with an inner diameter of 17 mm, an outer diameter of 47 mm, and a width of 14 mm, fitted with a contact rubber seal. The bearings were run into continuous rotation at a pulley load of 160 Kgf, repeating quick acceleration from the rotational speed of the bearing inner ring of 2000 rpm to 14000 rpm, and quick deceleration from 14000 rpm to 2000 rpm. The durability test was scheduled to terminate after 500 hours, but when shaking occurred due to peeling on the transmission surface of the bearing outer ring, the test was ended. The test was conducted four times.

High Temperature-High Speed Burning Test 2.3 g of a grease was sealed in deep groove ball bearings (with a plastic cage) with an inner diameter of 17 mm, an outer diameter of 47 mm, and a width of 14 mm, fitted with a contact rubber seal. The bearings were run into continuous rotation at a bearing inner ring rotational speed of 22000 rpm, a bearing outer ring temperature of 150° C., a radial load of 10 Kgf, and an axial load of 20 Kgf. The durability test was scheduled to terminate after 1000 hours, but when the bearing outer ring temperature exceeded 165° C. due to burning of the bearings, the test was ended. The test was conducted three times.

Grease Leakage Test 2.3 g of a grease was sealed in deep groove ball bearings (with a plastic cage) with an inner diameter of 17 mm, an outer diameter of 47 mm, and a width of 14 mm, fitted with a contact rubber seal. The bearings were run for 20 hours at a bearing inner ring rotational speed of 15000 rpm, a bearing outer ring temperature of 150° C., a radial load of 10 Kgf, and an axial load of 20 Kgf. The weight of the grease leaked by the end of the test was measured. The test was conducted four times. The results are shown in % by weight based on the total weight of the grease. Samples with the result of not more than 10% by weight were recognized to pass this test.

EXAMPLES 2 to 14

A grease was prepared in the same way as in Example 1 except that the starting materials for the thickener and the base oils consisting of TDI, polyol ester, p-toluidine, and cyclohexyl amine were replaced by those shown in Table 1. The obtained grease composition was measured of the composition of the thickener based on 100 parts by weight of the base oil in the grease in the same way as in Example 1. Results are shown in Table 2. The obtained grease was subjected to the same measurements and tests as in Example 1. Results are shown in Table 1.

Comparative Examples 1 to 14

A grease was prepared in the same way as in Example 1 except that the starting materials for the thickener and the base oils consisting of TDI, polyol ester, p-toluidine, and cyclohexyl amine were replaced by those shown in Table 3. The obtained grease composition was measured of the composition of the thickener based on 100 parts by weight of the base oil in the grease in the same way as in Example 1. Results are shown in Table 4. The obtained grease was subjected to the same measurements and tests as in Example 1. Results are shown in Table 3.

In Tables 1 to 4, MDI refers to diphenylmethane-4,4'-diisocyanate, and $A^1$ to $A^{16}$ stand for the compounds represented by the following formulae, respectively.

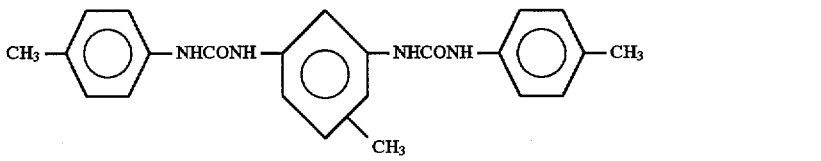

($A^1$)

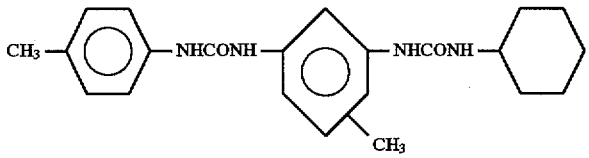

($A^2$)

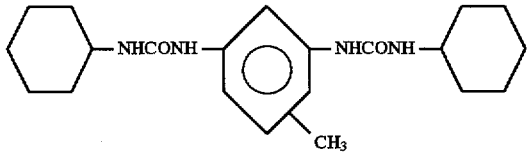

($A^3$)

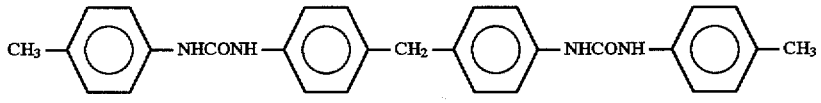

($A^4$)

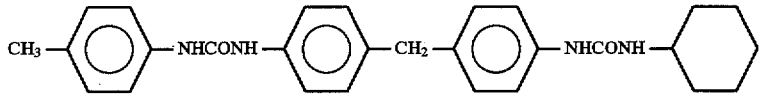

($A^5$)

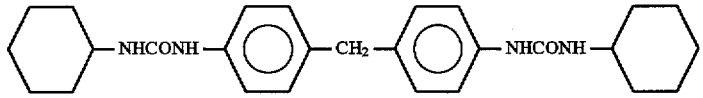

($A^6$)

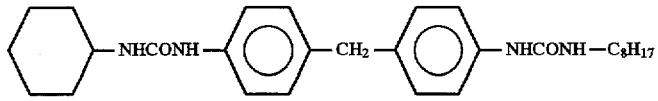

($A^7$)

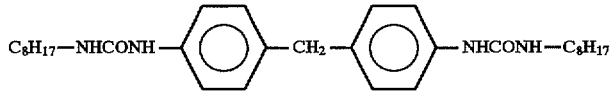

($A^8$)

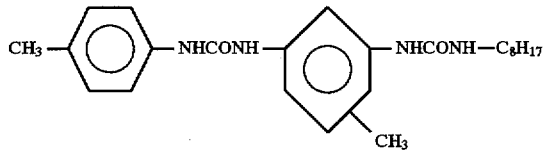

($A^9$)

-continued

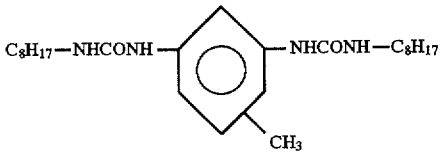

(A10)

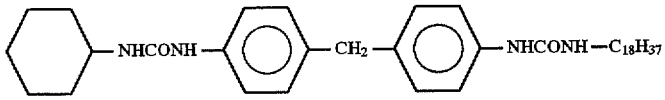

(A11)

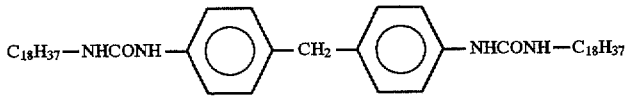

(A12)

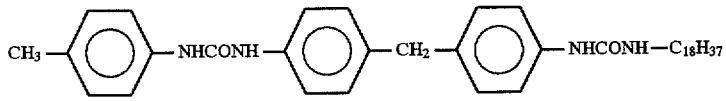

(A13)

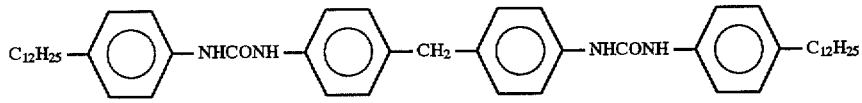

(A14)

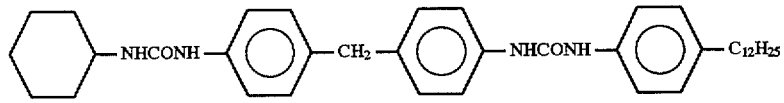

(A15)

The dialkyl diphenyl ether used as a base oil was a mixture of alkyl substituted dialkyl diphenyl ethers having 12 to 14 carbon atoms. The poly-α-olefin used as a base oil was a mixture of hydrides of trimer to octamer of 1-decen. The diester used as a base oil was dioctyl sebacate. The polyol ester used as a base oil was an ester of a mixture of pentaerythritol and saturated carboxylic acid having 8 to 12 carbon atoms.

TABLE 1

| | | | Example | | | | | | | | | | | | | |
|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 |
| Starting Materials of Thickener | diisocyanate (mol) | TDI | 0.78 | | | 0.66 | | | 0.52 | | | 0.78 | | | | |
| | | MDI | | 0.54 | 0.55 | | 0.43 | 0.44 | | 0.32 | 0.33 | | 0.54 | 0.44 | 0.54 | 0.54 |
| | monoamine (mol) | p-toluidine | 1.40 | 0.97 | 0.61 | 0.79 | 0.78 | 0.57 | 0.94 | 0.58 | 0.46 | 1.25 | 0.76 | 0.48 | 0.87 | 0.87 |
| | | cyclohexyl amine | 0.16 | 0.11 | 0.49 | 0.53 | 0.09 | 0.31 | 0.10 | 0.07 | 0.20 | 0.31 | 0.33 | 0.39 | 0.22 | 0.22 |
| Composition of Base Oil | dialkyl diphenyl ether (parts by wt) | | | 100 | 70 | | 70 | 70 | | | 89 | 100 | | 40 | | |
| | poly-α-olefin (parts by wt) | | | | 30 | 67 | 30 | | 100 | | | | 80 | 60 | | 90 |
| | diester (parts by wt) | | | | | | | | | 20 | | | 20 | | 20 | 10 |
| | polyolester (parts by wt) | | 100 | | | 33 | | | | | 11 | | | | 80 | |
| | mineral oil (parts by wt) | | | | | | | 30 | | 80 | | | | | | |
| Kinematic Viscosity of Base Oil ($mm^2$/sec., 40° C.) | | | 100 | 100 | 79 | 258 | 79 | 100 | 96 | 100 | 89 | 45 | 123 | 123 | 123 | 76 |
| Mixture Consistency | | | 213 | 246 | 238 | 268 | 255 | 251 | 275 | 279 | 282 | 207 | 246 | 274 | 241 | 249 |
| Quick Acceleration-Deceleration Test (hr) | | No. 1 | 500 | 500 | 500 | 500 | 500 | 500 | 500 | 500 | 500 | 500 | 500 | 500 | 500 | 500 |
| | | No. 2 | 500 | 500 | 500 | 500 | 500 | 500 | 500 | 500 | 500 | 500 | 500 | 500 | 500 | 500 |
| | | No. 3 | 500 | 500 | 500 | 500 | 500 | 500 | 500 | 500 | 500 | 500 | 500 | 500 | 500 | 500 |
| | | No. 4 | 500 | 500 | 500 | 500 | 500 | 500 | 500 | 500 | 500 | 500 | 500 | 500 | 500 | 500 |
| High Temperature-High speed Burning Test (hr) | | No. 1 | 1000 | 1000 | 1000 | 1000 | 1000 | 1000 | 1000 | 1000 | 1000 | 1000 | 1000 | 1000 | 1000 | 1000 |
| | | NO. 2 | 1000 | 1000 | 1000 | 1000 | 1000 | 1000 | 1000 | 1000 | 1000 | 1000 | 1000 | 1000 | 1000 | 1000 |
| | | No. 3 | 1000 | 1000 | 1000 | 1000 | 1000 | 1000 | 1000 | 1000 | 1000 | 1000 | 1000 | 1000 | 1000 | 1000 |
| Grease Leakage Test (% by weight) | | No. 1 | 1.5 | 1.9 | 2.5 | 1.9 | 3.1 | 2.7 | 3.0 | 6.8 | 5.7 | 1.4 | 2.0 | 1.9 | 2.2 | 3.0 |
| | | No. 2 | 1.8 | 2.2 | 2.5 | 2.8 | 3.9 | 3.4 | 3.6 | 7.1 | 6.4 | 1.7 | 2.3 | 2.8 | 2.4 | 3.6 |
| | | No. 3 | 1.9 | 2.5 | 2.8 | 3.3 | 4.0 | 3.9 | 4.1 | 7.5 | 6.9 | 1.8 | 2.3 | 3.3 | 2.6 | 4.1 |
| | | No. 4 | 2.0 | 3.2 | 3.0 | 3.6 | 4.5 | 4.2 | 4.1 | 8.4 | 7.2 | 2.1 | 2.7 | 3.6 | 3.1 | 4.1 |

Note:
In High temperature-High speed Burning Test, bearings with sample No. 3 in Example 6, sample Nos. 2 and 3 in Examples 7, 8, and 14, and sample No. 3 in Example 12 were about to burn after the termination of the test, exhibiting extremely rough grinding feeling when the bearings are manually rotated.

TABLE 2

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Kind of Thickener (mol %) | $A^1$ (81) $A^2$ (18) $A^3$ (1) | $A^4$ (81) $A^5$ (18) $A^6$ (1) | $A^4$ (30) $A^5$ (50) $A^6$ (20) | $A^1$ (36) $A^2$ (48) $A^3$ (16) | $A^4$ (81) $A^5$ (18) $A^6$ (1) | $A^4$ (42) $A^5$ (46) $A^6$ (12) | $A^1$ (81) $A^2$ (18) $A^3$ (1) | $A^4$ (81) $A^5$ (18) $A^6$ (1) | $A^4$ (49) $A^5$ (42) $A^6$ (9) | $A^1$ (64) $A^2$ (32) $A^3$ (4) | $A^4$ (49) $A^5$ (42) $A^6$ (9) | $A^4$ (30) $A^5$ (50) $A^6$ (20) | $A^4$ (64) $A^5$ (32) $A^6$ (4) | $A^4$ (64) $A^5$ (32) $A^6$ (4) |
| (number of $R^1$/(number of $R^1$ + number of $R^3$)), in the formulae (1), (2), and (3) | 0.90 | 0.90 | 0.55 | 0.60 | 0.90 | 0.65 | 0.90 | 0.89 | 0.70 | 0.80 | 0.70 | 0.55 | 0.80 | 0.80 |
| Amount of Thickener based on 100 parts by weight of base oil (parts by wt) | (50) | (38) | (38) | (38) | (29) | (29) | (29) | (20) | (20) | (50) | (28) | (29) | (38) | (38) |

TABLE 3

| | | | Comparative Example | | | | | | | | | | | | | |
|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 |
| Starting Materials of Thickener | diisocyanate (mol) | TDI | | | 0.63 | 0.59 | | | | | | | | | | |
| | | MDI | 0.86 | 0.52 | | | 0.41 | 0.39 | 0.42 | 0.28 | 0.19 | 0.21 | 0.18 | 0.33 | 0.33 | |
| | monoamine (mol) | p-toluidine | 1.56 | | 1.01 | 1.19 | | | 0.14 | | | | | 0.11 | 0.26 | 0.33 |
| | | dodecyl aniline | | | | | | | | | 0.28 | | | | | |
| | | cyclohexyl amine | 0.17 | 0.52 | | | 0.75 | 0.62 | 0.27 | 0.84 | 0.28 | 0.11 | 0.21 | 0.25 | 0.40 | 0.33 |
| | | stearyl amine | | | | | 0.08 | 0.16 | 0.27 | | | 0.27 | 0.21 | | | |
| | | octyl amine | | | 0.52 | 0.25 | | | | | | | | | | |
| Composition of Base Oil | dialkyl diphenyl ether (parts by wt) | | 100 | | | 80 | 50 | | | | 100 | 100 | | 70 | 70 | |
| | poly-α-olefin (parts by wt) | | | 100 | 67 | 20 | | 100 | | | | | 100 | 30 | 30 | |
| | diester (parts by wt) | | | | | | | | 20 | | | | | | | 100 |
| | polyolester (parts by wt) | | | | 33 | | 50 | | 80 | 100 | | | | | | |
| Kinematic Viscosity of Base Oil ($mm^2$/sec., 40° C.) | | | 100 | 48 | 258 | 79 | 55 | 256 | 26 | 32 | 100 | 100 | 48 | 79 | 79 | 12 |
| Mixture Consistency | | | 195 | 230 | 290 | 285 | 270 | 260 | 258 | 270 | 250 | 245 | 250 | 312 | 276 | 292 |
| Quick Acceleration-Deceleration Test (hr) | | No. 1 | 500 | 500 | 500 | 500 | 454 | 429 | 500 | 500 | 500 | 325 | 284 | 500 | 500 | 480 |
| | | No. 2 | 500 | 460 | 500 | 500 | 416 | 387 | 500 | 500 | 500 | 245 | 255 | 481 | 500 | 442 |
| | | No. 3 | 500 | 383 | 500 | 500 | 349 | 350 | 487 | 437 | 500 | 219 | 210 | 377 | 467 | 379 |
| | | No. 4 | 500 | 325 | 500 | 500 | 278 | 203 | 426 | 318 | 331 | 133 | 186 | 352 | 296 | 366 |
| High temperature-High speed Burning Test (hr) | | No. 1 | 264 | 1000 | 687 | 512 | 1000 | 1000 | 1000 | 1000 | 1000 | 622 | 580 | 1000 | 1000 | 516 |
| | | NO. 2 | 181 | 1000 | 655 | 490 | 1000 | 1000 | 1000 | 1000 | 1000 | 537 | 549 | 920 | 1000 | 494 |
| | | No. 3 | 122 | 952 | 598 | 472 | 1000 | 1000 | 1000 | 1000 | 914 | 421 | 371 | 816 | 1000 | 486 |
| Grease Leakage Test (% by weight) | | No. 1 | 1.3 | 2.3 | 2.8 | 1.9 | 7.3 | 8.2 | 9.5 | 2.4 | 5.9 | 18.3 | 20.1 | 10.2 | 7.1 | 8.5 |
| | | No. 2 | 1.3 | 2.5 | 3.0 | 2.3 | 8.0 | 9.0 | 16.7 | 2.9 | 7.3 | 27.5 | 25.9 | 12.6 | 7.9 | 9.3 |
| | | No. 3 | 1.5 | 2.6 | 3.0 | 2.6 | 8.9 | 10.8 | 21.0 | 3.6 | 8.2 | 38.1 | 35.0 | 14.5 | 8.4 | 10.1 |
| | | No. 4 | 1.6 | 2.8 | 3.1 | 2.7 | 10.2 | 12.7 | 23.8 | 3.7 | 9.3 | 40.8 | 39.8 | 16.0 | 9.0 | 12.5 |

Note:
In High temperature-High speed Burning Test, bearings with sample No. 2 in Comparative Example 2 and sample Nos. 2 and 3 in Comparative Example 6 were about to burn after the termination of the test, exhibiting extremely rough grinding feeling when the bearings are manually rotated.

TABLE 4

| | Comparative Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Kind of Thickener (mol %) | $A^4$ (81) $A^5$ (18) $A^6$ | $A^6$ (25) $A^7$ (50) $A^8$ | $A^1$ (64) $A^9$ (32) $A^{10}$ | $A^1$ (100) | $A^6$ (81) $A^{11}$ (18) $A^{12}$ | $A^6$ (64) $A^{11}$ (32) $A^{12}$ | $A^4$ (4) $A^6$ (16) $A^6$ | $A^6$ (100) | $A^{14}$ (25) $A^{15}$ (50) $A^6$ | $A^6$ (9) $A^{11}$ (42) $A^{12}$ | $A^6$ (25) $A^{11}$ (50) $A^{12}$ | $A^4$ (9) $A^5$ (42) $A^6$ | $A^4$ (16) $A^5$ (48) $A^6$ | $A^4$ (25) $A^5$ (50) $A^6$ |

TABLE 4-continued

| | Comparative Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| | (1) | (25) | (4) | | (1) | (4) | (16) $A^5$ (16) $A^{11}$ (32) $A^{13}$ (16) | | (25) | (49) | (25) | (49) | (36) | (25) |
| (number of $R^1$/(number of $R^1$ + number of $R^3$)), in the formulae (1), (2), and (3) | 0.90 | — | — | — | — | — | 0.34 | — | — | — | — | 0.31 | 0.40 | 0.50 |
| Amount of Thickener based on 100 parts by weight of base oil (parts by wt) | (80) | (38) | (38) | (34) | (29) | (29) | (29) | (27) | (20) | (18) | (18) | (10) | (20) | (20) |

What is claimed is:

1. A grease composition for a rolling bearing comprising 10 to 60 parts by weight of a mixture of diurea compounds as a thickener based on 100 parts by weight of a base oil, said mixture of diurea compounds having a composition of:

(a) 25 to 90 mol % of a diurea compound represented by the formula (1)

$$R^1-NH\overset{O}{\overset{\|}{C}}NH-R^2-NH\overset{O}{\overset{\|}{C}}NH-R^1, \quad (1)$$

(b) 9 to 50 mol % of a diurea compound represented by the formula (2)

$$R^1-NH\overset{O}{\overset{\|}{C}}NH-R^2-NH\overset{O}{\overset{\|}{C}}NH-R^3, \text{ and} \quad (2)$$

(c) 1 to 30 mol % of a diurea compound represented by the formula (3)

$$R^3-NH\overset{O}{\overset{\|}{C}}NH-R^2-NH\overset{O}{\overset{\|}{C}}NH-R^3, \quad (3)$$

wherein $R^1$ stands for aromatic-containing hydrocarbon group having 7 to 12 carbon atoms, $R^2$ stands for a divalent aromatic-containing hydrocarbon group having 6 to 15 carbon atoms, and $R^3$ stands for a cyclohexyl group or an alkylcyclohexyl group having 7 to 12 carbon atoms, a value of (number of $R^1$/(number of $R^1$+number of $R^3$)) in said mixture being 0.55 to 0.95.

2. The composition as claimed in claim 1 wherein each of said diurea compounds represented by the formula (1) to (3) is selected from the group consisting of compounds represented by the following formulae and mixtures thereof:

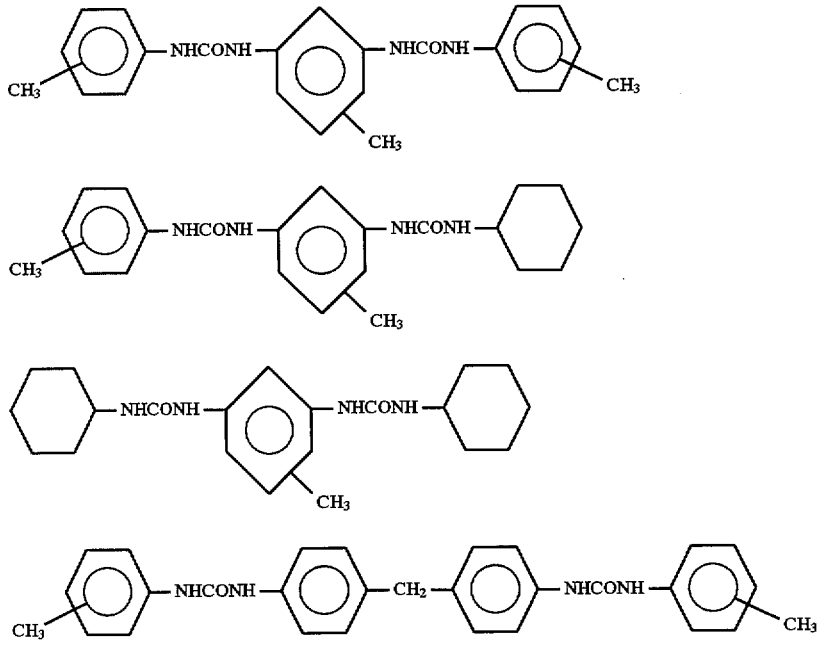

-continued

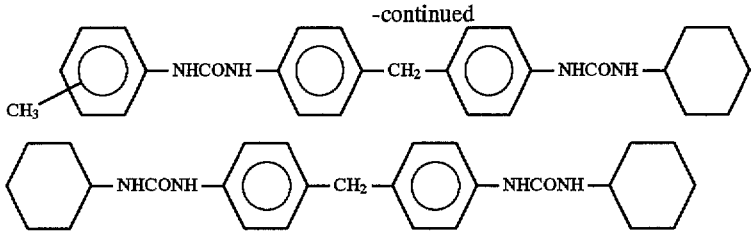

3. The composition as claimed in claim 1 wherein said base oil contains a base oil selected from the group consisting of dialkyl diphenyl ether, ester synthetic oil, and mixtures thereof, and has a kinematic viscosity of 40 to 400 $mm^2/s$ at 40° C.

4. The composition as claimed in claim 3 wherein said composition contains 10 to 100% by weight of dialkyl diphenyl ether based on a total weight of said base oil.

5. The composition as claimed in claim 3 wherein said dialkyl diphenyl ether is selected from the group consisting of compounds represented by the following formulae and mixtures thereof:

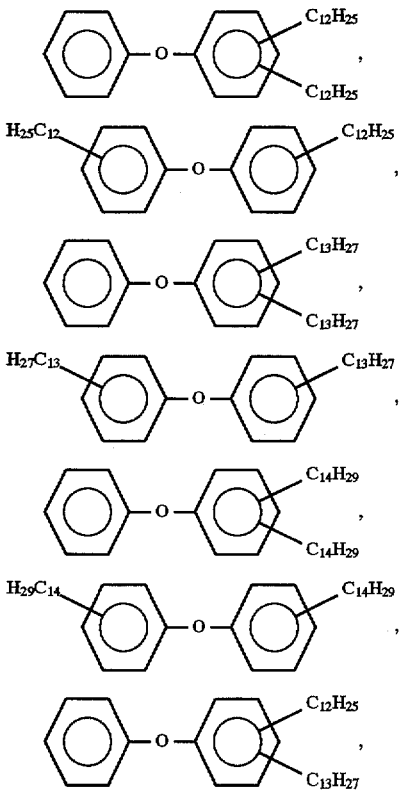

-continued

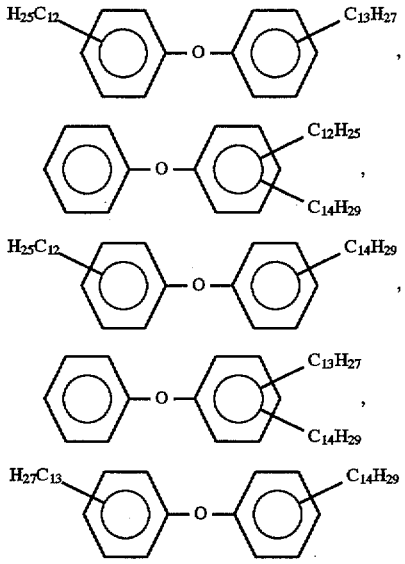

6. The composition as claimed in claim 3 wherein said composition contains 20 to 100% by weight of ester synthetic oil based on a total weight of said base oil.

7. The composition as claimed in claim 3 wherein said ester synthetic oil is selected from the group consisting of diester, polyolester, and mixtures thereof.

8. The composition as claimed in claim 1 wherein said base oil contains poly-α-olefin.

9. The composition as claimed in claim 1 further comprising an additive selected from the group consisting of a gelling agent, an antioxidant, an extreme pressure agent, an oilness agent, a rust preventive, a metal deactivator, a viscosity index improver, and mixtures thereof.

* * * * *